US008827327B2

(12) United States Patent
Kutschat

(10) Patent No.: US 8,827,327 B2
(45) Date of Patent: Sep. 9, 2014

(54) NEAR AND REMOTE CONTROLLED VEHICLE DOOR LOCK

(75) Inventor: Horst Kutschat, Wuppertal (DE)

(73) Assignee: D. La Porte Soehne GmbH, Wuppertal (DE)

( * ) Notice: Subject to any disclaimer, the term of this patent is extended or adjusted under 35 U.S.C. 154(b) by 1038 days.

(21) Appl. No.: 12/450,716

(22) PCT Filed: Apr. 14, 2008

(86) PCT No.: PCT/EP2008/002946
§ 371 (c)(1),
(2), (4) Date: Oct. 8, 2009

(87) PCT Pub. No.: WO2008/125323
PCT Pub. Date: Oct. 23, 2008

(65) Prior Publication Data

US 2010/0045052 A1 Feb. 25, 2010

(30) Foreign Application Priority Data

Apr. 12, 2007 (DE) ..... 20 2007 005 292 U

(51) Int. Cl.
*E05C 3/06* (2006.01)

(52) U.S. Cl.
USPC ..... 292/196; 292/216; 292/201; 292/DIG. 23

(58) Field of Classification Search
USPC ..... 292/216, 201, DIG. 23
See application file for complete search history.

(56) References Cited

U.S. PATENT DOCUMENTS 3,285,645 A * 11/1966 Roethel ..... 292/30
3,666,305 A * 5/1972 Schlichter ..... 292/48

(Continued)

FOREIGN PATENT DOCUMENTS

DE 35 00 550 10/1985
DE 39 23 726 1/1991

(Continued)

OTHER PUBLICATIONS

International Search Report, Sep. 2008.

*Primary Examiner* — Mark Williams
(74) *Attorney, Agent, or Firm* — Collard & Roe, P.C.

(57) ABSTRACT

The invention relates to a vehicle door lock for locking and closing doors of motor vehicles, particularly of doors of agricultural machines, such as tractors, having a rotary catch arrangement and a release mechanism, by means of which the rotary catch arrangement can be unlocked, wherein the rotary catch arrangement has a recess for a lock case having a locking stud, in which at least one, preferably two rotary catches are pivotally supported, wherein the rotary catch is drivably connected to a rotary catch spring, particularly in the rotary catch opening direction (D), and wherein in the lock case at least one pivotable pawl is disposed, by means of which the rotating movement of the rotary catch can be locked, and thus the rotary catch can be closed, wherein the release mechanism has a near controllable releasing unit and a remote controllable releasing unit having a transverse tube with remote control means disposed therein, a remote control button, and a cable pull mechanism operatively connected to remote releasing means, and wherein the pawl can be actuated both using the near controlled releasing unit and the remote controlled releasing unit such that the locking of the rotary catch can be released, wherein the release mechanism has an actuating lever, by means of which the pawl can be actuated, and which can also be actuated by means of the near controlled releasing unit and by means of the remote controlled releasing unit.

59 Claims, 11 Drawing Sheets

(56) References Cited

U.S. PATENT DOCUMENTS

Figure 1:
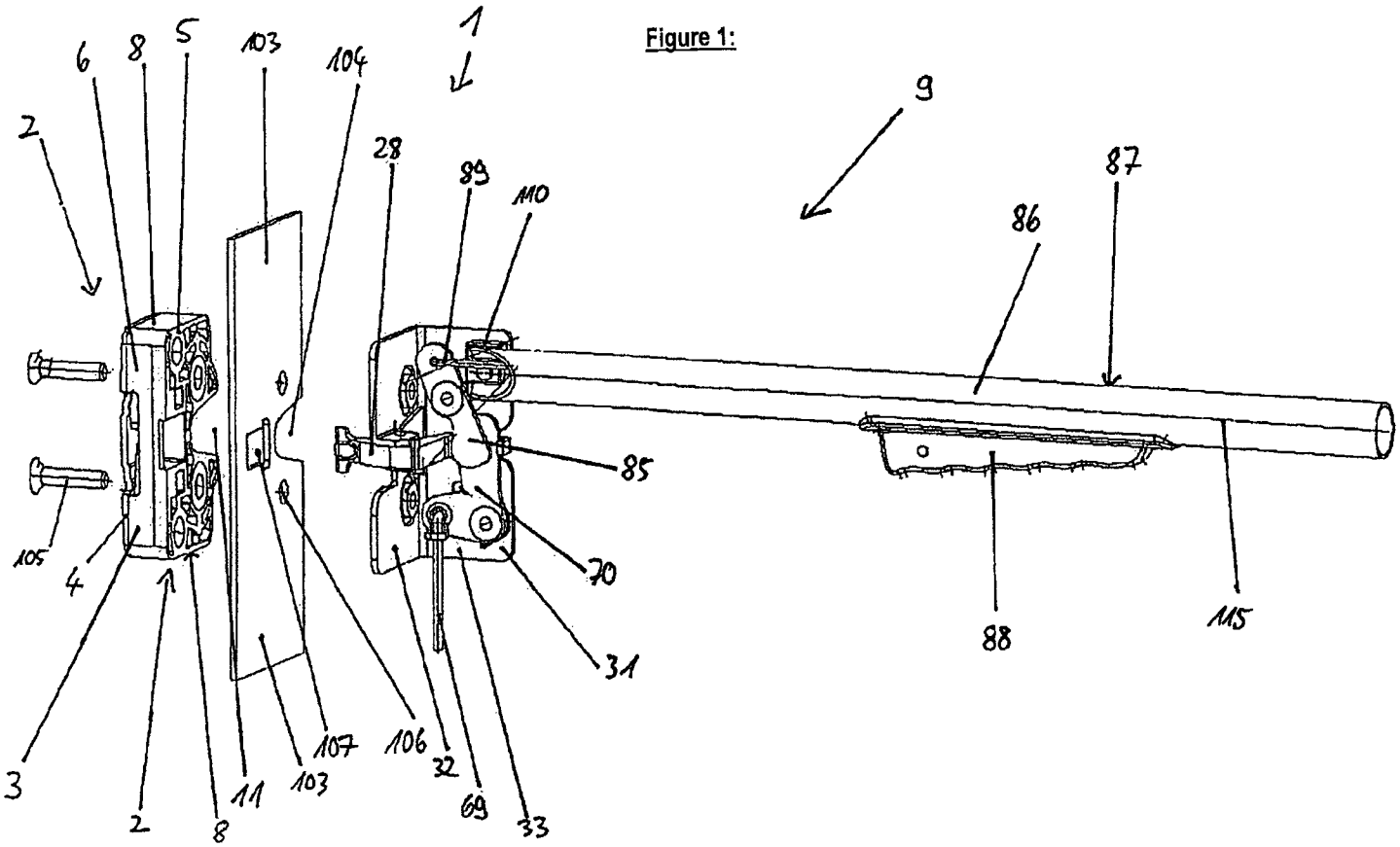

| | | | | |
|---|---|---|---|---|
| 3,858,916 | A * | 1/1975 | Torii et al. | 292/45 |
| 6,419,284 | B1 * | 7/2002 | Kutschat | 292/56 |
| 6,942,259 | B2 * | 9/2005 | Marzolf et al. | 292/216 |
| 7,338,097 | B2 * | 3/2008 | Marzolf et al. | 292/216 |
| 2004/0113441 | A1 * | 6/2004 | Lane et al. | 292/336.3 |
| 2009/0134638 | A1 | 5/2009 | Kutschat | |

FOREIGN PATENT DOCUMENTS

| | | |
|---|---|---|
| DE | 199 52 012 | 5/2001 |
| DE | 10 2005 016 253 | 11/2005 |
| DE | 10 2006 012 956 | 3/2007 |
| EP | 1 096 086 | 5/2001 |

* cited by examiner

NEAR AND REMOTE CONTROLLED VEHICLE DOOR LOCK

CROSS REFERENCE TO RELATED APPLICATIONS

This application is the National Stage of PCT/EP2008/002946 filed on Apr. 14, 2008, which claims priority under 35 U.S.C. §119 of German Application No. 20 2007 005 292.8 filed on Apr. 12, 2007. The international application under PCT article 21(2) was not published in English.

The invention relates to a vehicle door lock for locking and closing doors of motor vehicles, in particular doors of agricultural machines such as for example tractors, having a rotary latch arrangement and having a release mechanism for the rotary latch arrangement, which release mechanism has a locally actuable release device and a remotely actuable release device, with the remotely actuable release device having a traverse tube with remote-release means arranged therein, having a remote-actuation button and having a cable pull mechanism operatively connected to the remote-release means.

A vehicle door lock of said type is known for example from DE 199 52 012 A1. Said vehicle door lock has a flat, rectangular lock case having a cutout for a closing bolt, with the lock case having arranged in it two rotatably mounted rotary latches, which are spring-loaded in an opening rotational direction and which engage around or release the closing bolt, and a pivotable pawl, by means of which the rotational movement of the rotary latches can be blocked and the lock locked. For this purpose, the pawl has two pawl lever arms which are aligned approximately at right angles to one another, and is pivotably mounted in the angle region in which the two pawl lever arms are connected to one another. Furthermore, a pawl detent piece is provided on one of the two pawl lever arms at the end side, the counterpart detent toothing of which is situated opposite member detent toothings of the rotary latches and, when the rotary latch members engage around, engages into the detent spaces of the member detent toothings. A release mechanism of the door lock has a locally actuable release device and a remotely actuable release device, by means of which the pawl can be actuated in such a way that the locking of the rotary latches can be released. The locally actuable release device has a local-release lever which can be actuated by pulling a door handle, with the local-release lever being directly operatively connected to the pawl in the region of the pawl lever arm which has the detent piece. The remotely actuable release device has a traverse tube which is pivotable with respect to the lock case and in which is arranged a remote-actuation button which projects beyond the tube casing and which is operatively connected to remote-actuation means which are arranged within the traverse tube and which in turn are operatively connected via a pull cable or a rod guided within the traverse tube to a pivotable remote-release lever arranged at the lock-side end of the traverse tube. The pawl is actuated by means of the remote-release lever which is directly operatively connected to the pawl in the region of that latching lever arm which does not have the detent piece. As a result of a longitudinally movable and fixable arrangement of the remote-actuation means together with the remote-actuation button on the traverse tube, it is ensured that the traverse tube is pivotable relative to the lock case and the position of the remote-actuation means together with the remote-actuation button can be adapted to the pivot angle. At its end facing away from the lock, the traverse tube also has a pinched tube portion which is provided with a slot and by means of which the traverse tube is screwed to a frame strut of the vehicle door.

DE 10 2005 016 253 A1 discloses a remotely actuable release device of a generic door lock. In said release device, the traverse tube has, instead of the pinched tube portion, an internal thread body which is fixedly inserted into the end of the traverse tube and which has a threaded bore which extends preferably in the axial direction of the traverse tube and into which is screwed a fastening screw which extends through a shell body and the frame strut to which the tube is fastened. Here, the shell body is placed against a face end, which is arranged perpendicular to the longitudinal axis of the shell body, of the traverse tube, with the shell body having for this purpose a planar contact surface which is situated opposite the face end of the traverse tube. Said fastening device can be adapted to the respective profile of a frame strut in a simple manner, and is simple to assemble.

Said known locally and remotely actuable door locks have been proven. It is however slightly disadvantageous that the lock case has two cutouts for the engagement of the locally actuable release device and of the remotely actuable release device. Furthermore, the known release mechanisms are not suitable for door locks having a rotary latch arrangement with two rotary latches, each of which can be actuated by means of in each case one pawl.

It is an object of the present invention to create a door lock, which has a locally and remotely actuable release device, of the type specified in the introduction, which door lock is easy to assemble, can be produced in a cost-effective manner and has a functionally reliable lock mechanism.

Said object is achieved by means of the features of the vehicle door lock described herein. Advantageous refinements of the invention are further described herein.

Figure 2:
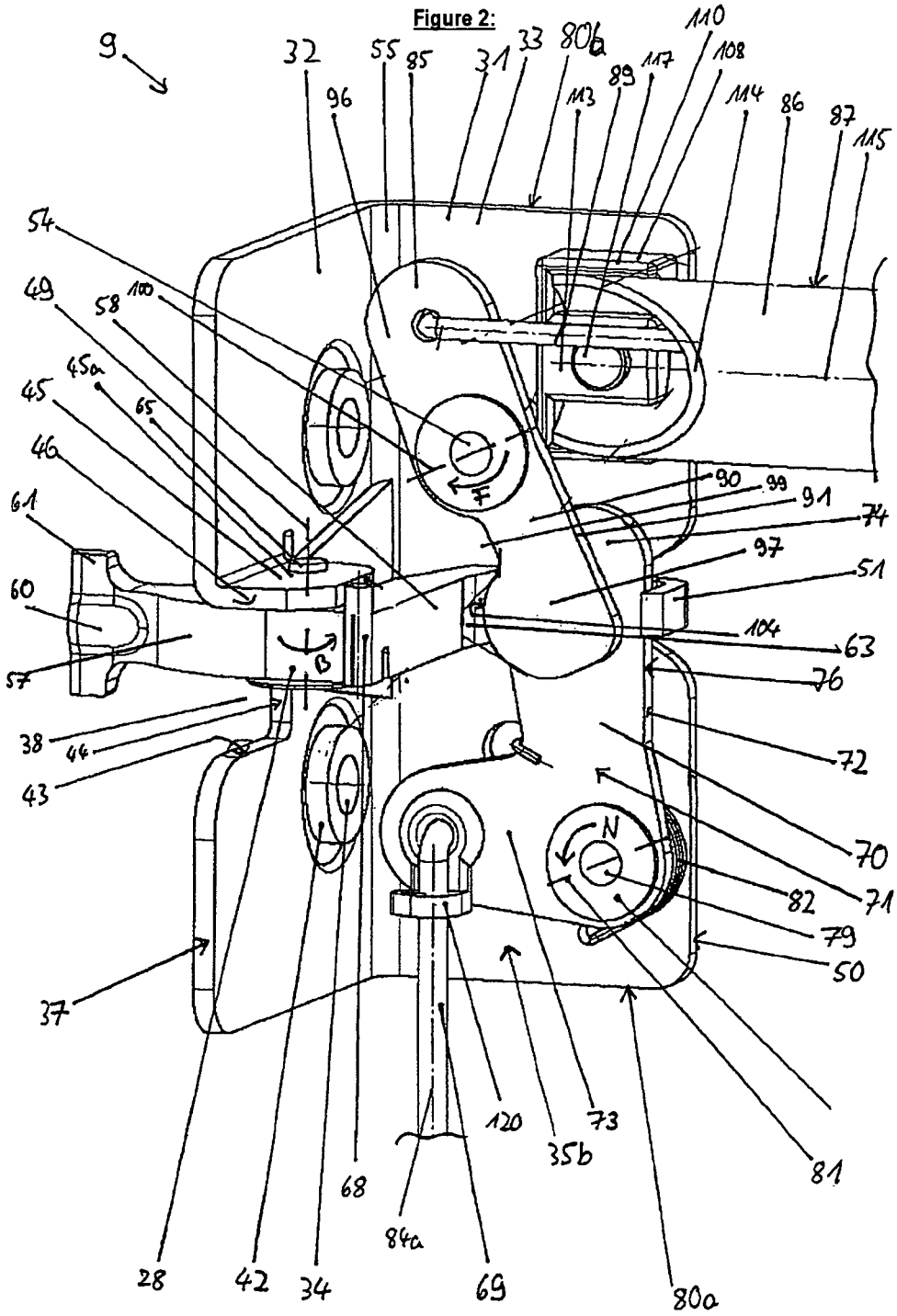
Figure 3:
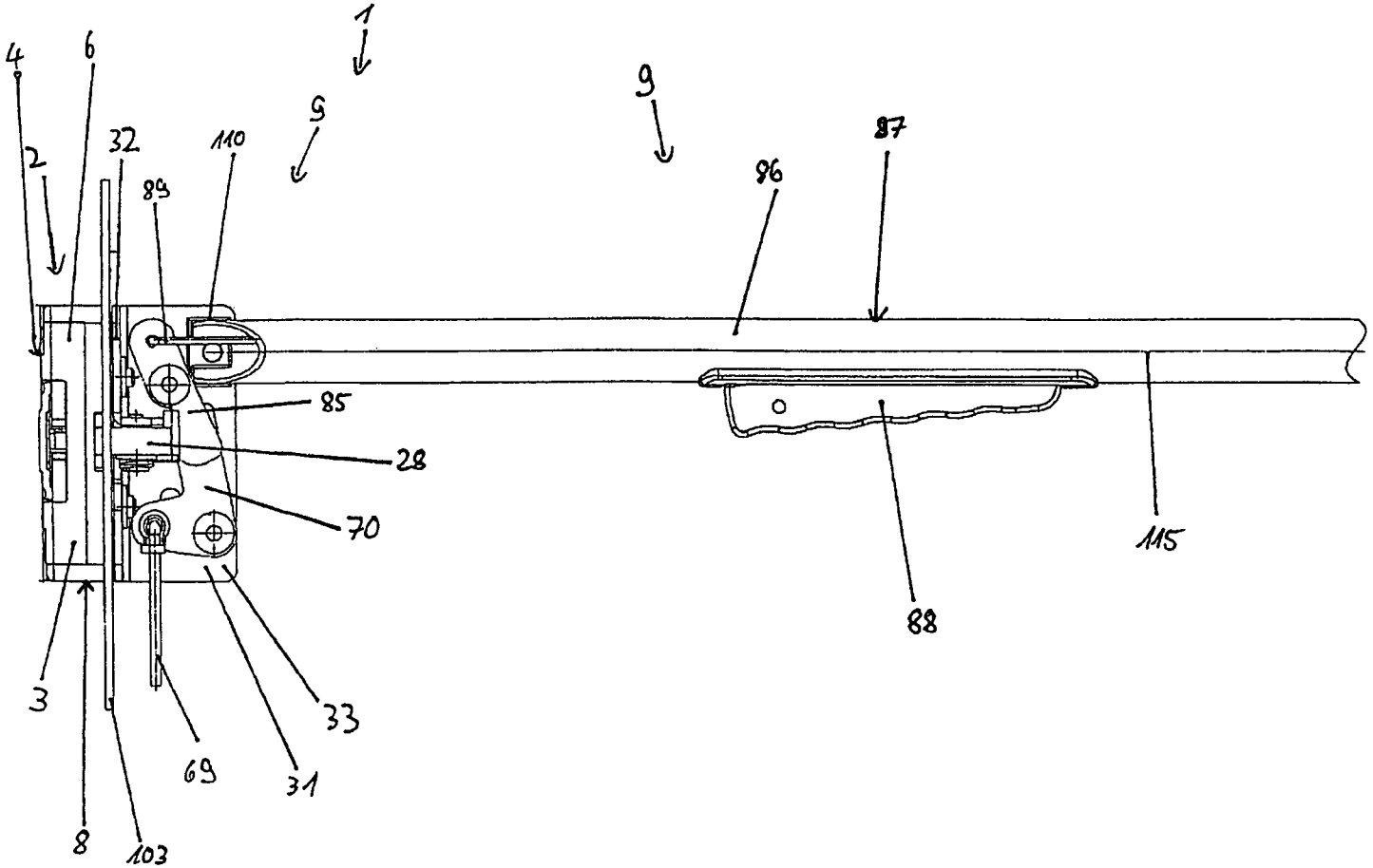
Figure 4:
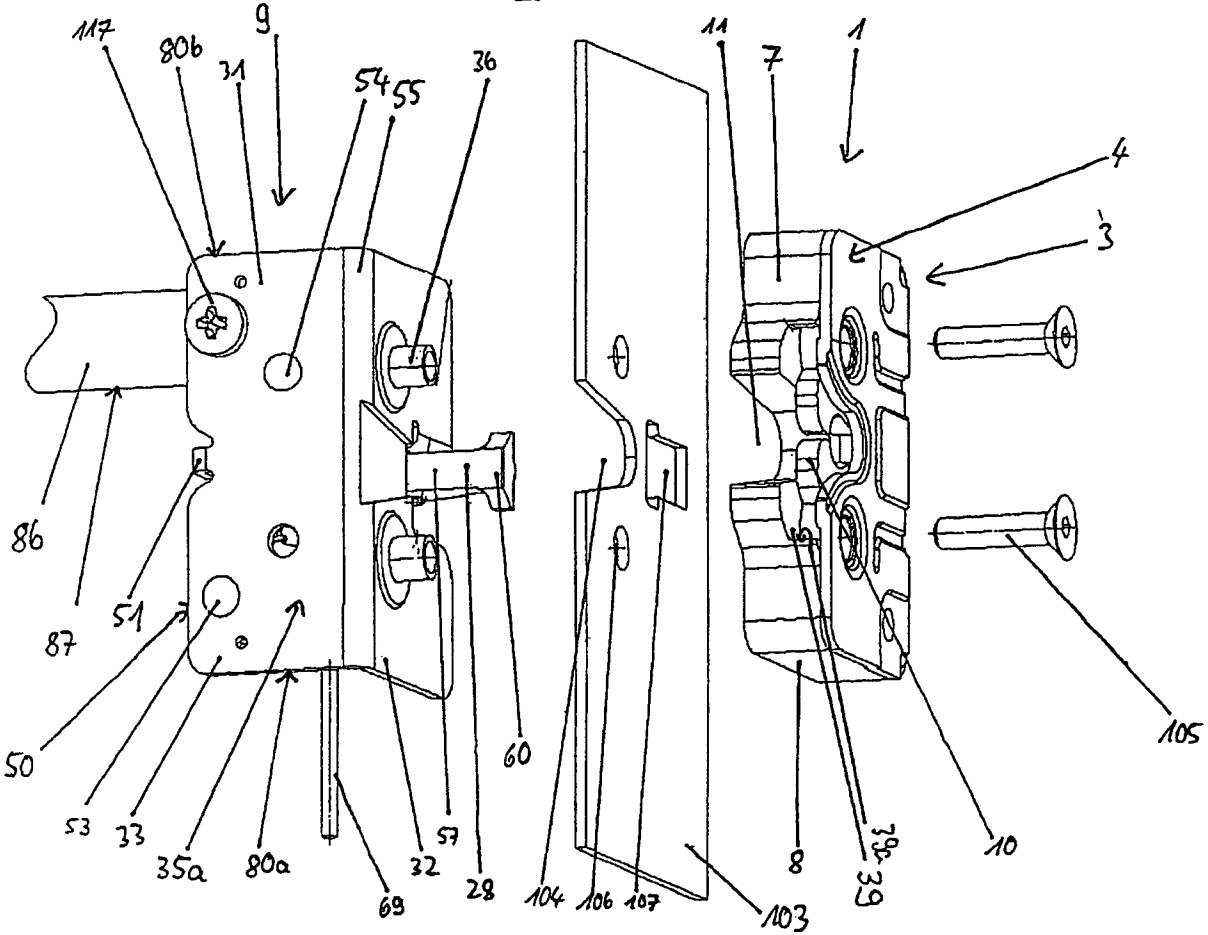
Figure 5:
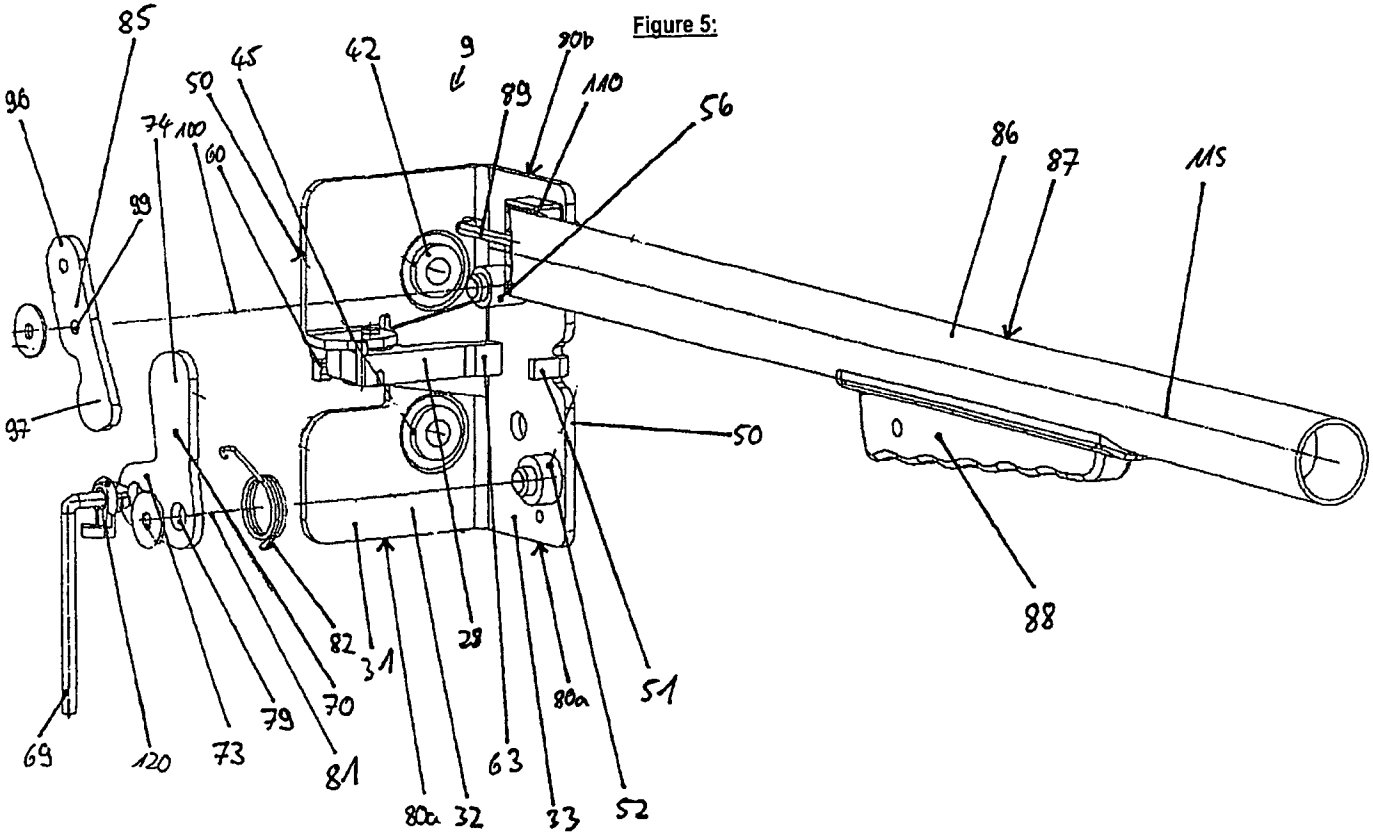
Figure 6:
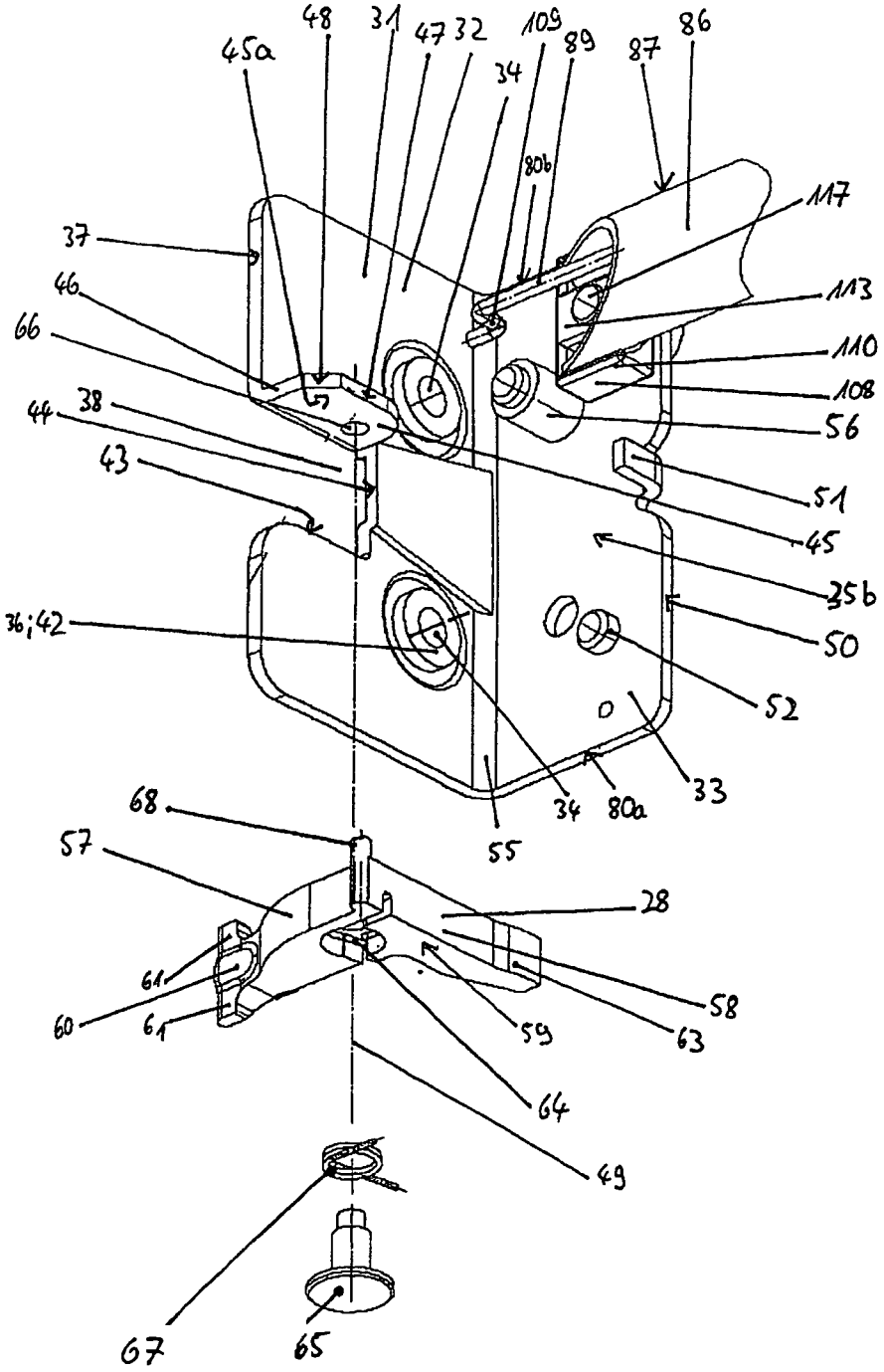
Figure 7:
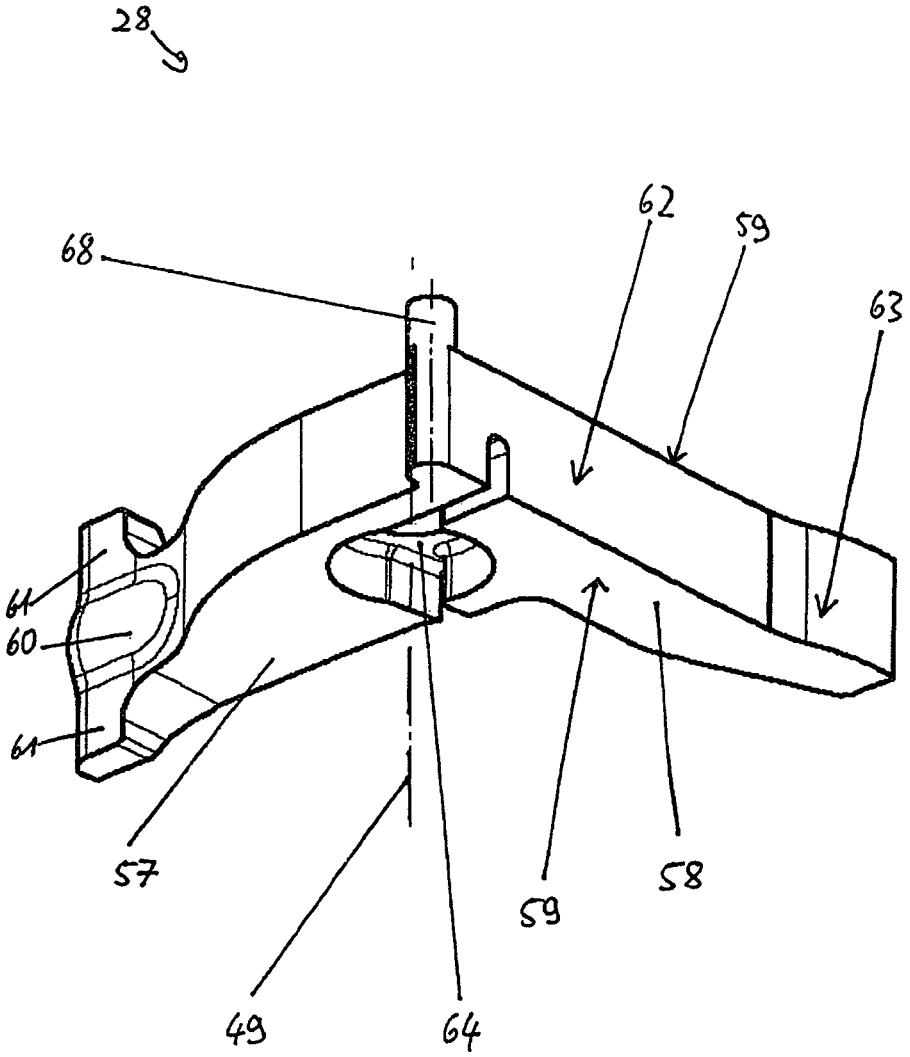
Figure 8:
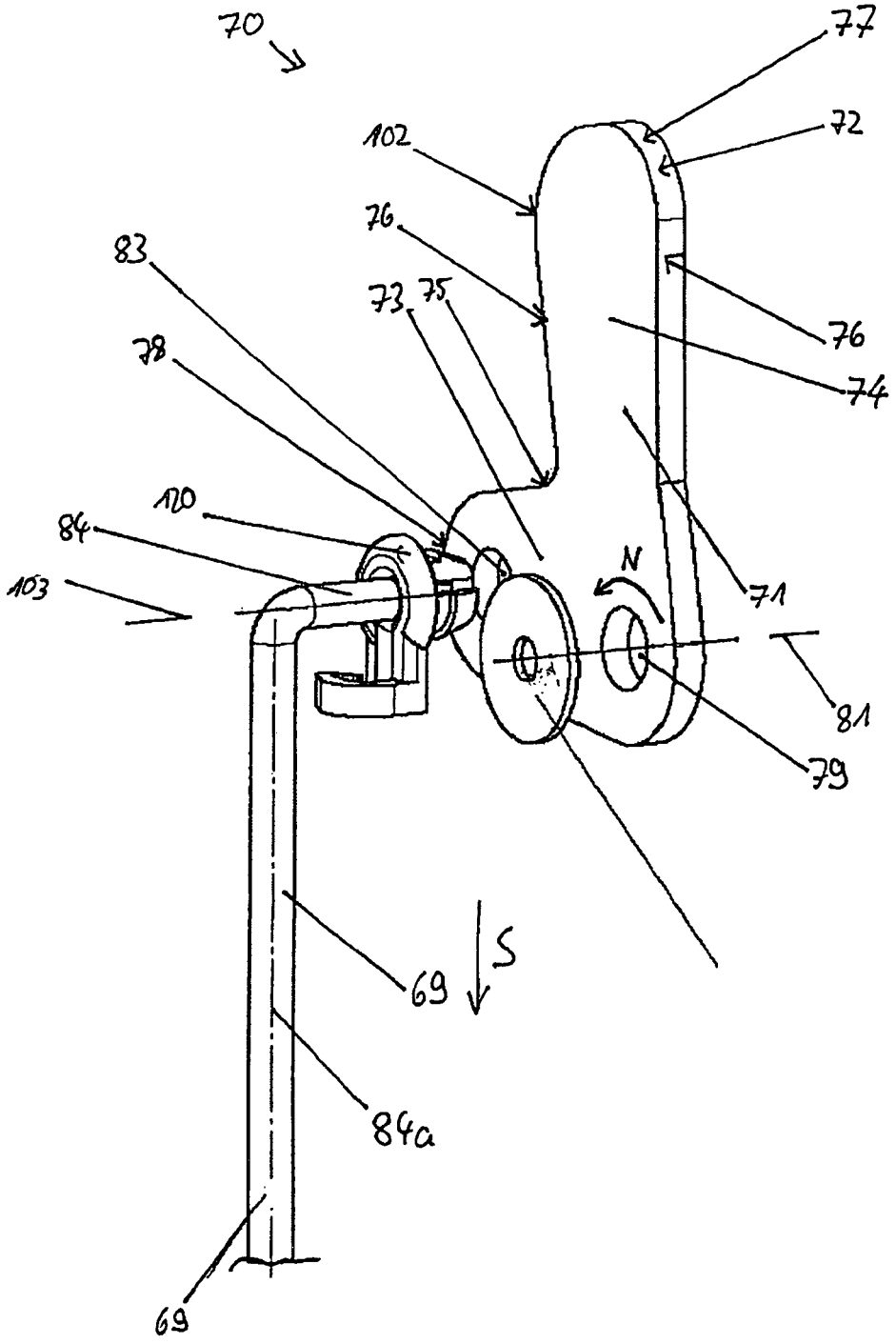
Figure 9:
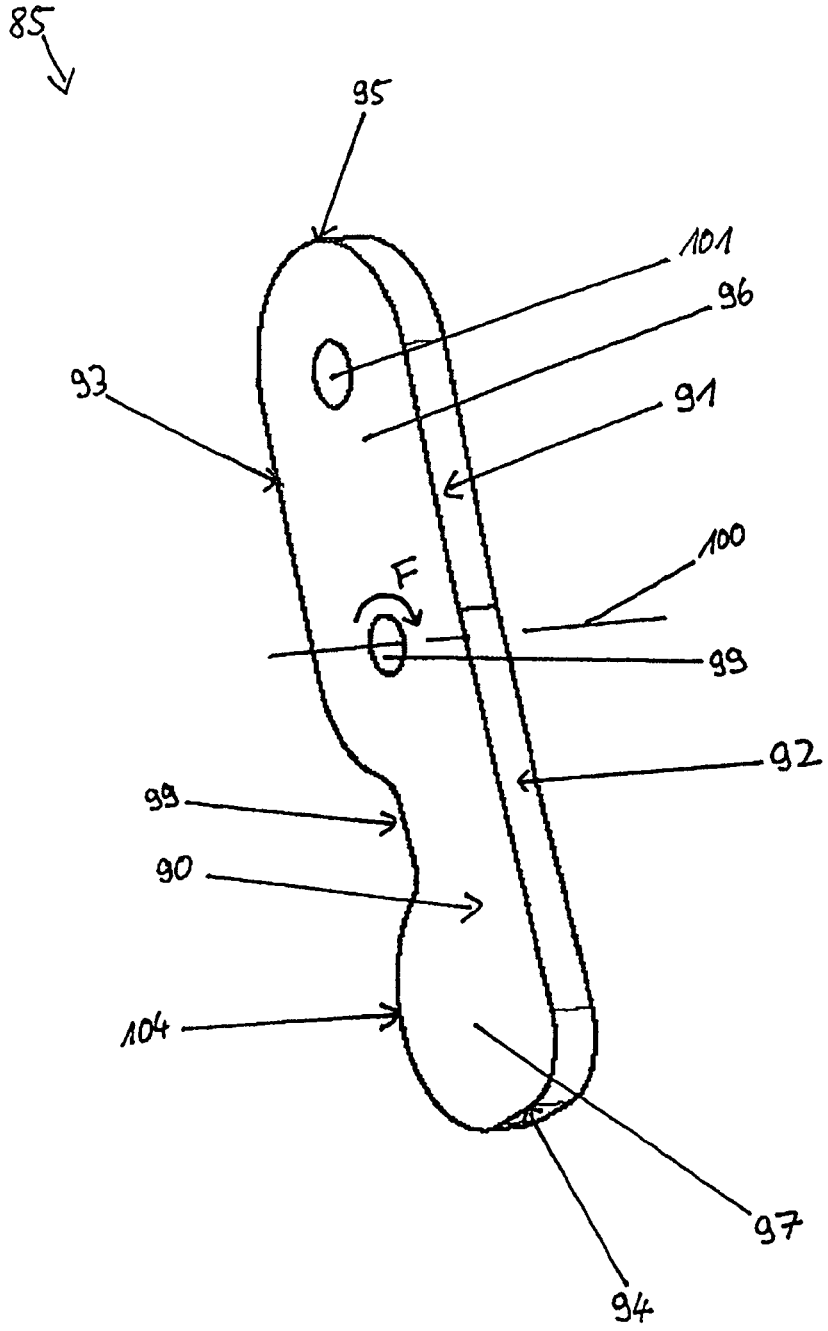
Figure 10:
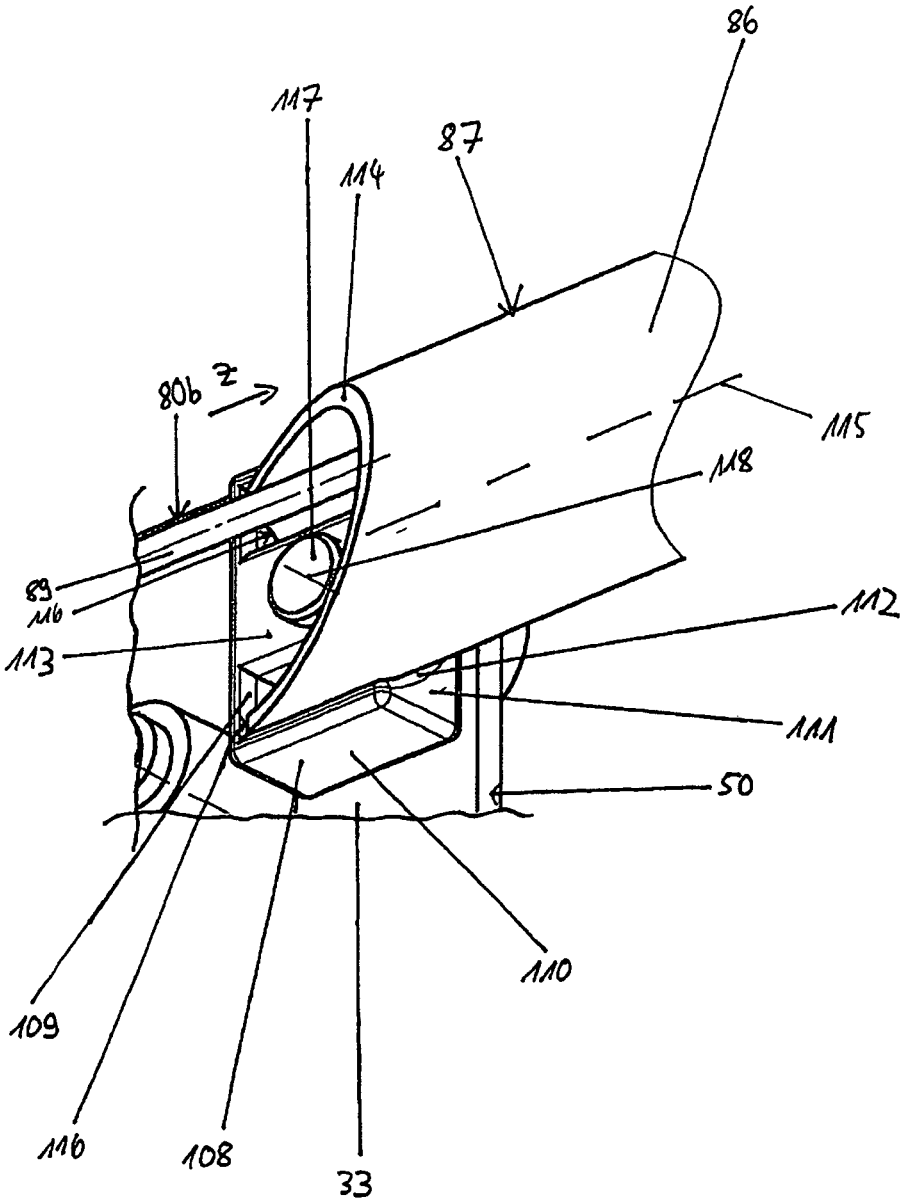
Figure 11:
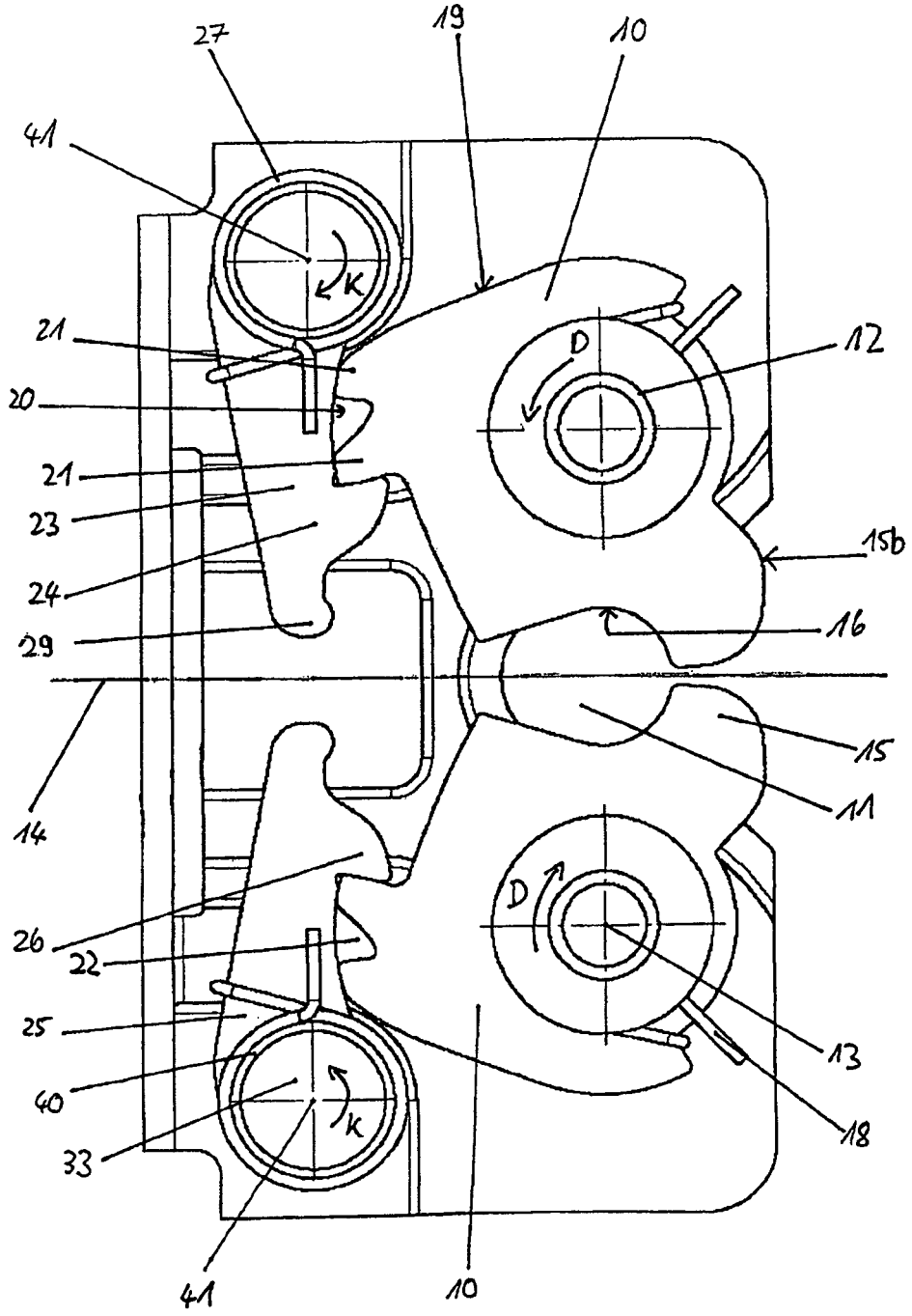

The invention will be explained in more detail by way of an example below, on the basis of a drawing in which:

FIG. 1 shows an isometric, actuating-lever-side exploded illustration of the door lock according to the invention, FIG. 2 shows an actuating-lever-side view of a release mechanism of the door lock according to the invention according to FIG. 1, on an enlarged scale and with only a part of a traverse tube, FIG. 3 shows an actuating-lever-side view of the door lock according to the invention, substantially as in FIG. 1, FIG. 4 shows an isometric exploded illustration, from the rear side of the angle plate, of the door lock according to the invention according to FIG. 1, with only a part of the traverse tube, FIG. 5 shows an isometric, actuating-lever-side exploded illustration of the release mechanism of the door lock according to the invention according to FIG. 1, FIG. 6 shows an isometric, actuating-lever-side exploded illustration of an angle plate, an actuating lever and in each case a part of the traverse tube and of a pull rod of the release mechanism of the door lock according to the invention according to FIG. 1, FIG. 7 shows an isometric view of the actuating lever, FIG. 8 shows an isometric view of a local-release lever and of a connecting rod of a locally actuable release device of the release mechanism of the door lock according to the invention, FIG. 9 shows an isometric view of a remote-release lever of a remotely actuable release device of the release mechanism of the door lock according to the invention, FIG. 10 shows an isometric view of the connection of the traverse tube to an angle plate of the release mechanism of the door lock according to the invention, and FIG. 11 shows a cover-side view of a rotary latch arrangement of the door lock according to the invention, without a cover of a lock case.

The door lock 1 according to the invention (FIGS. 1,3,4) has a rotary latch arrangement 2 and a release mechanism 9 having a locally actuable release device and a remotely actuable release device in each case for unlocking the rotary latch arrangement 2.

The rotary latch arrangement 2 which is known from DE 10 2006 012 956 A1, and to which reference is hereby made (FIGS. 1,3,4,11), has a substantially cuboidal lock case 3 with a planar base plate or rear wall 4, with a cover or front wall 5 situated opposite the base plate 4 and substantially parallel thereto, two longitudinal walls 6,7 which are parallel to one another and perpendicular to the base plate 4, and two transverse walls 8 which are parallel to one another and perpendicular to the longitudinal walls 6,7. The lock case 3 serves to hold a lock mechanism which is known per se and which has two rotary latches 10. Furthermore, the lock case 3 has a V-shaped closing bolt cutout 11 which extends from the longitudinal wall 7 into the cover 5 and into the base plate 4 and through which a closing bolt (not illustrated) can be moved into and out of the lock case 3.

The two rotary latches 10 are arranged within the lock case 3 and are rotatably mounted on in each case one hollow cylindrical rotary latch mounting journal 12. The two rotary latch mounting journals 12 are expediently fixedly connected to the base plate 4 and have in each case one rotary latch mounting journal axis or rotary latch axis 13 which is perpendicular to the base plate 4. Furthermore, the two rotary latches 10 are arranged spaced apart from one another preferably symmetrically in relation to a transverse central plane 14 of the rotary latch arrangement 2. The rotary latches 10 are preferably plate-shaped elements, for example plates composed of steel, which extend parallel to the base plate 4. Each rotary latch 10 has formed on it in each case one locking lug 15 with a recess 16. The recesses 16 are arranged so as to point toward one another and serve to receive the closing bolt (not illustrated) which extends perpendicular to the base plate 4 and which is of preferably cylindrical design, as will be discussed in more detail further below. In an open lock position (not illustrated), the locking lugs 15 extend through a slot 39 which is provided in the longitudinal wall 7 and which extends perpendicular to the transverse central plane 14 (FIG. 4), said locking lugs 15 projecting laterally beyond the longitudinal wall 7 out of the lock case 3. Furthermore, the rotary latches 10 are spring-loaded by means of in each case one rotary latch spring 18 which seek to hold the rotary latches 10 in the open position, that is to say to push apart the locking lugs 15 which point toward one another. The rotary latches 10 are thus connected, such that they can be driven in a rotary latch opening direction D about the rotary latch rotational axis 13, to in each case one rotary latch spring 18 (FIG. 11).

Furthermore, a peripheral wall or peripheral edge 19 of the rotary latches 10 substantially opposite the locking lugs 15 has in each case one toothing 20 having preferably in each case two rotary latch detent lugs 21 and an interposed detent depression 22. The toothing 20 serves, in a manner known per se, to lock the rotary latches 10 in the fully closed or prelatched position thereof by means of in each case one detent lever or pawl 23.

The two elongated pawls 23 are likewise preferably of plate-shaped design and extend parallel to the base plate 4, with in each case a pawl actuating section 24 being provided at one end and a pawl mounting section 25 at the other end. The pawl mounting section 25 has in each case one continuous pawl mounting bore 33, by means of which the pawls 23 are mounted, so as to be rotatable about a pawl rotational axis 41, on preferably hollow cylindrical pawl mounting journals 40. Here, the two pawl mounting journals 40 are expediently likewise fixedly connected to the base plate 4, and the pawl rotational axis 41 is perpendicular to the base plate 4. Furthermore, the two pawl mounting journals 40 are arranged spaced apart from one another, in corner regions formed in each case by the transverse walls 8 and the longitudinal wall 6, symmetrically in relation to the transverse central plane 14 of the door lock 2, such that the pawls 23 are also formed and arranged symmetrically with respect to the transverse central plane 14.

The pawl actuating section 24 of the two pawls 23 has in each case one integrally formed pawl detent lug 26 which is designed in each case so as to point toward the rotary latch 10 to be locked and which can engage into the toothing 20 of the rotary latch 10 so as to lock the latter. Here, the pawls 23 are spring loaded with in each case one pawl spring 27, which is preferably a leg spring, in such a way that the pawl detent lugs 26 are pushed in the direction of the rotary latches 10 or against the peripheral wall 19 of the rotary latches 10. The pawls 23 are thus connected, such that they can be driven about the pawl rotational axis 41 counter to a pawl actuating direction K, to in each case one pawl spring 27 (FIG. 11).

Furthermore, in each case one actuating or contact projection 29, which likewise extends in the direction of the rotary latches 10, is provided at the actuating-section-side end of the pawls 23. Said actuating projection 29 serves as a contact and engagement surface for an actuating lever 28 of the release mechanism 9, by means of which actuating lever 28 the pawls 23 can be pivoted about the pawl mounting journals 24 in the pawl actuating direction K in order to unlock the rotary latches 10, as will be explained in more detail further below.

Furthermore, a lever passage cutout 30 is provided in the cover 5 of the lock case 3. The lever passage cutout 30 is preferably of substantially rectangular design and is arranged centrally in relation to the transverse central plane 14 and in the region of the two actuating projections 29 of the pawls 23. The actuating lever 28 engages through the lever passage opening 30 into the lock case 3 and on the actuating projections 29, as will be discussed in more detail further below.

The release mechanism 9 of the door lock 1 according to the invention has a remotely actuable release device, that is to say a release device which can be actuated by an operator remotely from the rotary latch arrangement 2 to be actuated, and a locally actuable release device, that is to say a release device which can be actuated by an operator in the direct vicinity of the rotary latch arrangement 2 to be actuated, the actuating lever 28 which is or can be directly operatively connected both to the two release devices and also to the pawls 23 of the rotary latch arrangement 2 to be actuated, and an angle plate 31 which serves for mounting individual parts of the release mechanism 9 and for fastening the release mechanism 9 to the cover 5 of the lock case 3 of the rotary latch arrangement 2 to be actuated.

The angle plate 31 (FIGS. 1-6) has two plate limbs which are preferably at right angles to one another and in each case rectangular, a fastening or connecting plate 32 for rotatably mounting the actuating lever 28 and for fastening the release mechanism 9 to the lock case 3, and a mounting plate 33 for mounting some individual parts of the two release devices, which fastening or connecting plate 32 and mounting plate 33 are connected to one another at an angle plate bend edge 55. Furthermore, the angle plate 31 has an angle plate rear side 35*a* and an opposite angle plate inner side 35*b*.

The fastening plate 32 firstly has two continuous cylindrical fastening cutouts 34 which extend perpendicular to the fastening plate 32 and which are arranged correspondingly with respect to, that is to say spaced to the same extent from one another, the rotary latch mounting journals 12 of the rotary latch arrangement 2. In each case one cylindrical fastening sleeve 36 having a sleeve edge 42 which projects beyond the inner side 35*b* and having an internal thread (not illustrated) is expediently inserted into the fastening cutouts 34. The fastening sleeve 36 is inserted into the fastening cutouts 34 from the inner side 35*b*, and the sleeve edge 42 is preferably welded to the inner side 35*b*, such that the sleeve 36 is fixedly connected to the fastening plate 32.

Furthermore, the fastening plate 32 likewise has a lever passage cutout 38 which extends into the fastening plate 32 from a fastening plate longitudinal edge 37 situated opposite the angle plate bend edge 55. The preferably U-shaped lever passage cutout 38 is positioned substantially centrally between the fastening cutouts 34 and has two passage cutout side edges 43, which are parallel to one another and perpendicular to the fastening plate longitudinal edge 37, and a passage cutout base edge 44 which is perpendicular to said passage cutout side edges 43. A preferably plate-shaped mounting lobe 45 is integrally formed on one of the two passage cutout side edges 43, which mounting lobe 45 extends perpendicular to the fastening plate 32 and at the inside in relation to the angle plate 31. The mounting lobe 45 serves for rotatably mounting the actuating lever 28 and has two lobe side surfaces 45*a*, which are parallel to one another and perpendicular to the fastening plate 32 and to the fastening plate longitudinal edge 37, two lobe side edges 46, which are parallel to one another and perpendicular to the fastening plate 32, and a lobe stop edge 47 or lobe abutment edge 47 which is perpendicular to said lobe side edges 46, with the edges 46,47 preferably merging into one another via chamfer edges 48 or rounded corner edges (not illustrated). Furthermore, the mounting lobe 45 expediently has a continuous, preferably cylindrical lobe mounting cutout 66 whose cutout axis is perpendicular to the mounting lobe 45, in particular to the lobe side surfaces 45*a*, and constitutes an actuating lever rotational axis 49.

The mounting plate 33 has a stop lobe 51 which is integrally formed centrally on the end-side mounting plate longitudinal edge 50, which is situated opposite the angle plate bend edge 55, of said mounting plate 33, which stop lobe 51 extends perpendicular to the mounting plate 33 and inward in relation to the angle plate 31, the function of which stop lobe 51 will be explained in more detail further below.

Furthermore, the mounting plate 33 has a continuous, preferably cylindrical local-release mounting cutout 53 which is positioned in a corner region formed between the mounting plate longitudinal edge 50 and a mounting plate side edge 80*a*. Furthermore, the mounting plate 33 has a continuous, preferably cylindrical remote-release mounting cutout 54 which is positioned in a corner region formed between the angle plate bend edge 55 and the opposite mounting plate side edge 80*b*. The function of the mounting cutouts 53,54 will be explained further below.

Furthermore, a box-like bearing block 110 (FIGS. 1-3, 5, 6, 10) for fastening a traverse tube 86 of the remotely actuable release device is fastened to the mounting plate 33 at the inside. The bearing block 110 is positioned in a corner region formed between the mounting plate longitudinal edge 50 and the mounting plate side edge 80*b*. Furthermore, the bearing block 110 has a preferably planar block base wall (not illustrated) which is parallel to the mounting plate 33, two opposite block side walls 108 which are perpendicular to the block base wall and which are parallel to one another, a block end wall 109 which is perpendicular to the block side walls 108 and to the block base wall, and a block mounting wall 111 which is situated opposite the block end wall 109 and which is parallel thereto. The block mounting wall 111 has a curved mounting edge 112 whose radius corresponds to the outer radius of a tube casing 87 of the traverse tube 86. Furthermore, a preferably cuboidal clamping block 113 is integrally formed on the block end wall 109 at the inner side of the block and preferably centrally in relation to the block end wall 109, which clamping block 113 expediently extends parallel to the block side walls 108 into the interior of the bearing block 110. The clamping block 113 is arranged spaced apart from the block base wall substantially by the wall thickness of the tube casing 87, such that an insertion slot (not illustrated) for the traverse tube 86 is formed between the block base wall and the clamping block 113. Centrally, the clamping block 113 also has a fastening bore with an internal thread (not illustrated) whose tube mounting cutout axis 118 (FIG. 10) is perpendicular to the block base wall and therefore to the mounting plate 33.

The actuating lever 28 (FIGS. 1-7) has two lever arms which are preferably substantially perpendicular to one another, an actuating lever output arm 57 and an actuating lever driving arm 58, and two actuating lever side surfaces 59 which are parallel to one another and to the mounting lobe 45.

The actuating lever output arm 57 is provided, at its end, with an actuating lug 60 which is of widened design in relation to the actuating lever side surfaces 59 and which has in each case one actuating surface 61 laterally at the end side. The actuating surfaces 61 are formed substantially perpendicular to the actuating lever side surfaces 59 and on an actuating lever outer side 62.

The actuating lever driving arm 58 has provided on it, at the end and on the outer side, a driving surface 63 which preferably has a slightly arched or convex profile as viewed in a side view (not illustrated) of the actuating lever 28.

Furthermore, the actuating lever 28 has, in the bend region or in the transition region of its two lever arms 57,58, a preferably cylindrical actuating lever mounting cutout 64 which extends continuously from one actuating lever side surface 59 to the opposite actuating lever side surface and which serves for rotatably mounting the actuating lever 28 on an actuating lever stepped pin 65 which is inserted into the actuating lever mounting cutout 64 and into the lobe mounting cutout 66 of the mounting lobe 45 and is preferably riveted in the lobe mounting cutout 66. The actuating lever 28 is thereby connected, so as to be rotatable about the actuating lever rotational axis 49, to the angle plate 31, in particular to the mounting lobe 45. Here, the actuating lever 28 is arranged so as to engage with the actuating lug 60 through the lever passage cutout 38 of the fastening plate 32, and the actuating surfaces 61 are aligned away from the mounting plate 33. Here, the actuating lever driving arm 58 extends at the inner side in relation to the angle plate 31 and, in the non-actuated position of the actuating lever 28, is aligned substantially parallel to the fastening plate 32, with the driving surface 63 preferably facing away from the fastening plate 32. In the non-actuated position of the actuating lever 28, the actuating lever output arm 57 is arranged substantially parallel to the mounting plate 33.

Furthermore, the actuating lever 28 is spring-loaded by means of an actuating lever spring 67, in particular a leg spring, which seeks to hold the actuating lever 28 in a non-actuated position or drive the latter counter to an actuating lever actuating direction B (FIG. 2) about the actuating lever rotational axis 49. For this purpose, the actuating lever spring 67 is expediently supported with one spring leg on the actuating lever 28 and with the other spring leg on the mounting lobe 45. To limit the rotational movement of the actuating lever 28 counter to the actuating lever actuating direction B, the actuating lever 28 also has a preferably cylindrical, and expediently integrally formed, stop pin 68 which projects at one side, and in the direction of the mounting lobe 45, beyond that actuating lever side surface 59 which faces toward the mounting lobe 45. For this purpose, the stop pin 68 is arranged on the lever outer side 62 of the actuating lever 28 and at a corner edge or bend edge of the transition region of the two lever arms 57,58. In the non-actuated position of the actuating lever 28, the stop pin 68 bears against the lobe stop edge 47 of the mounting lobe 45, as a result of which the rotational movement of the actuating lever 28 counter to the actuating lever actuating direction B is blocked. The lobe stop edge 47 therefore serves as an abutment for the rotational movement of the actuating lever 28 counter to the actuating lever actuating direction B.

The locally actuable release device (FIGS. 1-5) has a connecting rod 69 and a preferably plate-shaped local-release lever 70 which expediently extends parallel to the mounting plate 33 and which is preferably composed of steel, and also further local-actuation means (not illustrated), for example a door handle.

The plate-shaped local-release lever 70 (FIGS. 1-5, 8) has two mutually parallel local-release lever side surfaces 71 and an encircling local-release lever peripheral edge 72. Here, the local-release lever side surfaces 71 are preferably parallel to the mounting plate 33. Furthermore, the local-release lever 70 has a local-release lever driving arm 73 and a local-release lever driven arm 74 which, together, enclose an angle of preferably 70 to 110°, with the angle preferably being acute. The local-release lever peripheral edge 72 therefore has a local-release lever inner edge 75 and a local-release lever outer edge 76 which merge into one another via a rounded local-release driven arm corner edge 77 and a rounded local-release driving arm corner edge 78.

Furthermore, a preferably cylindrical continuous local-release lever mounting cutout 79, whose cutout axis constitutes the local-release lever rotational axis 81, is provided in the bend region or connecting region or transition region of the two lever arms 73,74. The local-release lever rotational axis 81 is perpendicular to the local-release lever side surfaces 71 and, in the mounted state of the local-release lever 70, perpendicular to the mounting plate 33, that is to say perpendicular to the actuating lever rotational axis 49. A local-release stepped pin 52 is arranged in the local-release lever mounting cutout 79, which local-release stepped pin 52 is also inserted, in particular pressed, into the local-release mounting cutout 53 in the mounting plate 33. The local-release lever 70 is rotatably mounted on the local-release stepped pin 52 and is thus connected, so as to be rotatable about the local-release lever rotational axis 81, to the angle plate 31, in particular to the mounting plate 33. The local-release lever 70 is also spring-loaded by a local-release lever spring 82, in particular a leg spring, which seeks to hold the local-release lever 70 in a non-actuated position or drives said local-release lever 70 counter to a local-release lever actuating direction N (FIG. 2) about the local-release lever rotational axis 81. For this purpose, the local-release lever spring 82 is expediently supported with one spring leg against the local-release lever 70 and with a second spring leg against the mounting plate 33. The rotational movement of the local-release lever 70 counter to the local-release lever actuating direction N is limited by the stop lobe 51 of the mounting plate 33, against which stop lobe 51 the local-release lever 70 bears with its local-release lever outer edge 76 in the region of the local-release lever driven arm 74 in the non-actuated position.

The local-release lever 70 preferably also bears with the inner-side part of the local-release driven arm corner edge 77, a rounded or curved or convex local-release lever driven edge 102, against the driving surface 63 of the actuating lever 28 without initially actuating the latter.

The local-release lever 70 therefore is or can be directly operatively connected to the actuating lever 28, in particular via the local-release lever driven edge 102 and the driving surface 63.

Furthermore, a preferably cylindrical rod-receiving cutout 83 is provided at the end side on the local-release lever driving arm 73, which rod-receiving cutout 83 is continuous from one side surface 71 to the opposite side surface 71. In the rod-receiving cutout 83, the connecting rod 69 is connected, so as to be pivotable about a rod rotational axis 103 which is perpendicular to the mounting plate 33, with a rod end piece 84, which is bent substantially at right angles, to the local-release lever 70 by means of a rod clip 120 such as is known per se. Furthermore, the connecting rod 69 is operatively connected to the further local-release means, preferably a vehicle door handle (not illustrated) which is arranged on the outside of the vehicle close to the rotary latch arrangement 2, and said connecting rod 69 can be driven, by means of an actuation of the vehicle door handle, in a rod actuation direction S (FIG. 8) which is preferably parallel to the rod axial direction 84*a*. In this way, the local-release lever 70 is connected, such that it can be driven in the local-release lever actuating direction N, to the connecting rod 69 and to the local-release means. The local-release lever 70 is thus connected, such that it can be driven in the local-release lever actuating direction N, via the connecting rod 69 to the local-release means.

The remotely actuable release device (FIGS. 1-5) has a pivotable remote-release lever 85, the traverse tube 86, a remote-actuation button 88 which is mounted on the traverse tube 86 and which projects beyond the tube casing 87 and which can be pressed in, remote-actuation means which are arranged within the traverse tube 86 and which are operatively connected to the remote-actuation button 88, and a pull cable (not illustrated) or pull rod 89. Here, the pull rod 89 is operatively connected both to the remote-release lever 85 and also to the remote-actuation means.

The preferably plate-shaped remote-release lever 85 (FIGS. 1-5, 9) which is of elongated design and which is preferably composed of steel is arranged at an angle-plate-side end of the traverse tube 86. The remote-release lever 85 expediently has two mutually parallel remote-release lever side surfaces 90 and an encircling remote-release lever peripheral edge 91. Here, the remote-release lever side surfaces 90 preferably extend parallel to the mounting plate 33.

Furthermore, the remote-release lever 85 has a remote-release lever driving arm 96 and a remote-release lever driven arm 97. An expediently cylindrical, continuous remote-release lever mounting cutout 99 is preferably provided centrally between the remote-release lever driving arm 96 and the remote-release lever driven arm 97, the cutout axis of which remote-release lever mounting cutout 99 constitutes the remote-release lever rotational axis 100. The remote-release lever rotational axis 100 is perpendicular to the remote-release lever side surfaces 90 and to the mounting plate 33, that is to say parallel to the remote-release lever rotational axis 81.

The remote-release lever peripheral edge 91 has two remote-release lever longitudinal edges 92,93 which merge into one another via a rounded remote-release driven arm corner edge 94 and a rounded remote-release driving arm corner edge 95. Here, that remote-release lever longitudinal edge 92 which faces away from the actuating lever 28 preferably has a substantially rectilinear profile as viewed in a side view, whereas that remote-release lever longitudinal edge 93 which faces toward the actuating lever 28 has, in the region of the remote-release lever driven arm 97, a constriction 99, and as a result, has a bulged portion at the driven arm end side, which bulged portion serves as a remote-release lever driven edge 104 with a preferably arched or convex profile.

A remote-release stepped pin 56 is arranged in the remote-release lever mounting cutout 99, which remote-release stepped pin 56 is also inserted, in particular pressed, into the remote-release mounting cutout 54 in the mounting plate 33. The remote-release lever 85 is rotatably mounted on the remote-release stepped pin 56 and is thereby connected rotatably about the remote-release lever rotational axis 100 to the angle plate 31, in particular to the mounting plate 33. The rotational movement of the remote-release lever 85 counter to a remote-release lever actuating direction F (FIGS. 2, 9) about the remote-release lever rotational axis 100 is limited by the fastening plate 32, against which the remote-release lever 85 abuts, or bears in a non-actuated position, with that part of its remote-release driving corner edge 95 which faces toward the actuating lever 28. The remote-release lever 85 is held in the non-actuated position by the actuating lever 28. For this purpose, the remote-release lever 85 bears with the remote-release driven edge 104 against the driving surface 63 of the actuating lever 28 without initially actuating the latter.

Furthermore, the remote-release lever actuating direction F opposes the local-release lever actuating direction N.

The remote-release lever 85 therefore is or can be preferably directly operatively connected to the actuating lever 28, in particular via the remote-release driven edge 104 and the driving surface 63.

Here, the remote-release driven arm 97 and the local-release driven arm 74 are arranged so as to partially overlap, or be partially in alignment with one another or one above the other, in a direction perpendicular to the mounting plate 33 (FIGS. 1-3).

Furthermore, a preferably cylindrical, continuous rod-receiving cutout 101 is provided at the end side on the remote-release lever driving arm 96. In the rod-receiving cutout 101, the pull rod 89 is connected, so as to be pivotable about a rod rotational axis (not illustrated) and otherwise immovable, with a hook-like rod end piece (not illustrated) which is bent at right angles, to the remote-release lever 85. The rod pivot axis is expediently perpendicular to the remote-release lever side surfaces 90 and to the mounting plate 33.

In the case of a pull cable, the latter has a cable hook which is bent at right angles and which is inserted into the rod-receiving cutout 101 (not illustrated).

The traverse tube 86 is fastened, as already explained above, to the mounting plate 33 by means of the bearing block 110. For this purpose, the traverse tube 86 preferably has, at its angle-plate-side end, an oblique end edge 114 which is adjoined by a tube stop edge 116 which is perpendicular to the tube longitudinal axis 115. Furthermore, the traverse tube 86 has a tube fastening cutout (not illustrated) which extends at the angle-plate-side end and centrally in relation to the tube stop edge 116. The traverse tube 86 is also inserted with its angle-plate-side end into the insertion slot of the bearing block 110 in such a way that the tube stop edge 116 abuts at the inside against the block end wall 109 and the tube casing 87 bears in a positively locking fashion at the outside against the mounting edge 112, with the oblique end edge 114 being aligned so as to face away from the mounting plate 33. Furthermore, from the angle plate rear side 35*a*, a tube fastening screw 117 is inserted or screwed into a further, preferably cylindrical cutout (not illustrated) provided in the mounting plate 33, into the tube fastening cutout, and into the fastening bore, which has an internal thread, of the clamping block 113. Said type of fastening makes it possible for the traverse tube 86 to duly be connected to the bearing block 110 and to the mounting plate 33 in an immovable and non-rotatable fashion in the mounted state, but also for the entire unit composed of bearing block 110 and traverse tube 86 to be pivotable about the tube mounting cutout axis 118, such that the position of said tube can therefore be fixed in a variable fashion, before the tube fastening screw 117 is tightened. The alignment of the tube longitudinal axis 115 can therefore be adapted to the external conditions, that is to say to the respective vehicle dimensions.

At its end situated opposite the angle-plate-side end, the traverse tube 86 has for example a pinched tube portion, such as is known from DE 199 52 012 A1, which is provided with a slot and by means of which the traverse tube 86 is screwed to a frame strut of the vehicle door (not illustrated). Alternatively, the traverse tube 86 is for example fastened to the frame strut as described in DE 10 2005 016 253 A1.

The pull rod 89 is inserted into the traverse tube 86 at the angle-plate-side end of the traverse tube 86, and is operatively connected to the remote-actuation means (not illustrated) and to the remote-actuation button 88 in such a way that the pressing of the remote-actuation button 88 by an operator from the interior of the vehicle causes a tensile force to be exerted on the pull rod 89. Said tensile force generates a movement of the pull rod 89 in the pull rod actuating direction Z (see FIG. 10) and therefore a rotation of the remote-release lever 85 in its remote-release lever actuating rotational direction F. The remote-release lever 85 is therefore connected, such that it can be driven in the remote-release lever actuating direction F about the remote-release lever rotational axis 100, to the pull rod 89.

The remote-actuation means which are arranged in the traverse tube 86 are known per se and are designed for example as in DE 199 52 012 A1 and can be positioned in a variable fashion in the traverse tube 86, preferably in the tube axial direction, to a limited extent.

In the assembled state of the rotary latch arrangement 2 and release mechanism 9 (FIG. 3), the fastening plate 32 of the angle plate 31 is fastened, with the interposition of a retaining plate 103, to the cover 5 of the lock case 3, with the cover 5, the retaining plate 103 and the fastening plate 32 being aligned parallel to one another. The retaining plate 103, which is arranged between the cover 5 and the fastening plate 32, for the cabin door (not illustrated) has bores 106 corresponding to the fastening cutouts 34 of the fastening plate 32, and a lever passage cutout 107 corresponding to the lever passage cutout 38. Furthermore, the retaining plate 103 also has a V-shaped closing bolt cutout 104.

Here, the fastening cutouts 34 of the fastening plate 32, the bores 106 and the rotary latch mounting journals 12 on the one hand, and the lever passage cutout 30 of the cover 5, the lever passage cutout 107 of the retaining plate 103 and the lever passage cutout 38 of the fastening plate 32 on the other hand, are arranged in alignment with one another in a direction perpendicular to the fastening plate 32. Furthermore, fastening screws 105 (FIGS. 1,4) are inserted from the base plate 4 through the rotary latch mounting journals 12, the bores 106 and through the fastening sleeves 36 which are inserted into the fastening cutouts 34; the lock case 3, the retaining plate 103 and the fastening plate 32 are thereby fixedly screwed to one another.

The mode of operation of the door lock 1 according to the invention will now be explained in more detail:

In a closed position of the rotary latch arrangement 2 and a non-actuated position of the release mechanism 9, the locking lugs 15 of the rotary latches 10 point toward one another and the closing bolt (not illustrated) is arranged in a positively locking fashion in the recesses 11 of the rotary latches 10, and is thereby fixedly encompassed by the latter. The rotation of the two rotary latches 10 back into their open position by the force of the rotary latch springs 18 is prevented by the two pawls 23. Said pawls 23 are pushed, by the force of the pawl rotary springs 27, with their pawl latching lugs 26 against the toothing 20 of the rotary latches 10, and thereby engage into the toothing 20, as a result of which the rotary latches 10 are locked.

Furthermore, the local-release lever 70 bears with its lobe stop edge 47 against the stop lobe 51 and the remote-release lever 85 bears with its remote-release driving corner edge 95 against the fastening plate 32 at the inside. It is also preferable for the local-release lever 70 to bear with its local-release driven edge 102, and the remote-release lever 85 with its remote-release driven edge 104, against the driving surface 63 of the actuating lever 28, but without actuating the latter.

The actuating lever 28 engages with its actuating lug 60 into the lock case 3 through the lever passage cutout 30 in the cover 5 of the lock case 3. Here, the actuating surfaces 61 of the actuating lug 60 preferably bear against the actuating or contact projections 29 of the pawls 23 without actuating the latter.

The opening or unlocking of the rotary latch arrangement 2 may now take place optionally by means of the remotely actuable release device or by means of the locally actuable release device.

To open the rotary latch arrangement 2 by means of the remotely actuable release device, the remote-actuation button 88 is pressed into the interior of the traverse tube 86 by an operator from the vehicle interior. As a result, the remote-actuation means exert a tensile force on the pull rod 89 in the direction Z, which tensile force causes the remote-release lever 85 to be pivoted in the remote-release lever actuating direction F. As a result, the remote-release lever 85 presses with the remote-release lever driven edge 104 against the driving surface 63 of the actuating lever 28. The torque which is generated in this way in turn causes the actuating lever 28 to be pivoted in the actuating lever actuating direction B and, in turn, to impart a force by means of the actuating lug 60 via the actuating surfaces 61 to the actuating or contact projections 29 of the pawls 23, which are thereby pivoted in the pawl actuating direction K, counter to the force of the pawl rotary springs 27. Here, the pawl detent lugs 26 are moved out of the toothing 20 of the rotary latches 10, as a result of which the rotary latches 10 are unlocked. The rotary latches 10, driven by the force of the rotary latch springs 18, snap into their open position in which the locking lugs 15 engage through the slot 39 and locking lug rear walls 15*b* are pressed against slot side edges 39*a* which serve as a stop and which are perpendicular to the base plate 3. Here, the closing bolt is pushed out of the lock case 3 by cutout walls 16.

After the remote-actuation button 88 is released, the latter is automatically pushed back out of the traverse tube 86 and into its initial position by a spring mechanism (not illustrated). As a result, a tensile force is exerted on the pull rod 89 counter to the pull rod actuating direction Z, and the remote-release lever 85 is thereby pivoted back, likewise into its initial position, counter to the remote-release lever actuating direction F. The remote-release lever 85 now no longer presses against the actuating lever 28. The actuating lever 28 thereupon snaps back into its initial position, driven by the force of the actuating lever spring 67. Here, the actuating lever 28 drives not only the pull rod but also the remote-release lever 85 counter to the remote-release lever actuating direction F. Furthermore, the pawls 23 are released again and rotate, driven by the force of the pawl rotary springs 27, counter to the pawl actuating direction K until said pawls bear with the pawl detent lugs 26 against the peripheral wall 19 of the rotary latches 10.

When opening the door lock 2 by means of the locally actuable release device, the actuating lever 28 is pivoted by means of the local-release lever 70. For this purpose, a tensile force is exerted on the connecting rod 69 in the rod actuating direction S, for example by pulling on a door handle (not illustrated) on the outside of the vehicle. The tensile force is transmitted to the local-release lever driving arm 73 of the local-release lever 70, as a result of which a torque is imparted to the local-release lever 70, causing the latter to be pivoted in the local-release lever actuating direction N. The local-release lever 70 thereby presses with the local-release driven edge 102 on the driving surface 63 of the actuating lever 28. This in turn causes the actuating lever 28 to be pivoted in the actuating lever actuating direction B and, as already described, to actuate the pawls 23, as a result of which the rotary latches 10 are unlocked.

When the door handle is released, the tensile force on the connecting rod 69 is also eliminated and the local-release lever 70 is pivoted back into its initial position by the force of the local-release lever spring 82, counter to the local-release lever actuating direction N, until said local-release lever 70 abuts with its local-release lever outer edge 76 in the region of the local-release lever driven arm 74 against the stop lobe 51. The actuating lever 28 and the pawls 23 likewise snap back into their initial positions as already described above. The connecting rod 69 is moved back into its initial position by means of a spring mechanism such as is known per se.

When closing the vehicle door, the closing bolt passes into the region of the recesses 11 of the rotary latches 10 again. As a result of the pressure of the closing bolt on the rotary latches 10, the latter are pivoted counter to the rotary latch opening direction D and counter to the pressure of the rotary latch springs 18. As a result of the rotational movement, the locking lugs 15 pass behind the closing bolt and engage around the latter. As a result of the pivoting of the rotary latches 10, the toothing 20 passes into the region of the detent lugs 26 of the pawls 23, wherein, on account of the pressure of the pawl rotary springs 27, the detent lugs 26 snap into the toothing 20, firstly into the detent depression 22 for a safety detent position and, with a further rotation of the rotary latches 10, behind the second rotary latch detent lug 21 as viewed in the rotary latch opening direction D for the fully closed position of the rotary latch arrangement 2.

The advantage of the door lock according to the invention is firstly that, on account of the partially overlapping arrangement of the plate-shaped local-release lever and plate-shaped remote-release lever, the release mechanism is of very space-saving design and is also very lightweight, but is nevertheless stable and functionally reliable. Furthermore, only one engagement cutout is required in the lock case, since both the locally actuable release device and also the remotely actuable release device act on the pawls via the same actuating lever.

Furthermore, the release mechanism according to the invention may also be used for door locks whose rotary latch arrangement has only one rotary latch and one pawl which locks the rotary latch, or whose rotary latch arrangement has two rotary latches but only one pawl which locks both rotary latches. Also, if a pull cable is used, the traverse tube may be of varied design and have one or more bends.

The invention claimed is:

1. A vehicle door lock for locking and closing doors of motor vehicles, the vehicle door lock having a rotary latch arrangement having a lock case which has a cutout for a closing bolt and in which is rotatably mounted at least one rotary latch, with the at least one rotary latch being connected to a rotary latch spring for driving the at least one rotary latch in the rotary latch opening rotational direction, the rotary latch arrangement also having at least one pivotable pawl arranged in the lock case for blocking the rotational movement of the at least one rotary latch and thereby locking the rotary latch arrangement, and a release mechanism for unlocking the rotary latch arrangement, the release mechanism having a locally actuable release device and a remotely actuable release device, the remotely actuable release device having a traverse tube, a remote release device arranged within the traverse tube, a remote-actuation button and a cable pull mechanism operatively connected to the remote release device, wherein the release mechanism has an actuating lever for actuating the at least one pivotable pawl to release the locking of the at least one rotary latch, wherein the actuating lever is actuated via the locally actuable release device or via the remotely actuable release device, both the locally actuable release device and the remotely actuable release device being directly operatively connected to the actuating lever to actuate the at least one pivotable pawl to release the locking of the at least one rotary latch.

2. The vehicle door lock as claimed in claim 1, wherein the actuating lever is directly connected to the locally actuable release device and to the remotely actuable release device such that the actuating lever is driven about an actuating lever rotational axis in an actuating lever actuating direction.

3. The vehicle door lock as claimed in claim 2, wherein the actuating lever is connected to an actuating lever spring such that the actuating lever is driven about the actuating lever rotational axis counter to the actuating lever actuating direction.

4. The vehicle door lock as claimed in claim 1, wherein the actuating lever has an actuating lever output arm and an actuating lever driving arm.

5. The vehicle door lock as claimed in claim 4, wherein the actuating lever output arm has, at the end, an actuating lug which is of widened design in relation to mutually parallel actuating lever side surfaces and which has in each case one actuating surface laterally at the end side.

6. The vehicle door lock as claimed in claim 5, wherein the actuating surfaces are formed substantially perpendicular to the actuating lever side surfaces and on an actuating lever outer side.

7. The vehicle door lock as claimed in claim 4, wherein the actuating lever driving arm has, at the end and on the outer side, a driving surface which has a slightly arched or convex profile as viewed in a side view of the actuating lever.

8. The vehicle door lock as claimed in claim 5, wherein the actuating lever engages with the actuating lug into the lock case through a lever passage cutout provided in the cover of the lock case.

9. The vehicle door lock as claimed in claim 1, wherein the locally actuable release device has a plate-shaped local-release lever and a local-actuation device.

10. The vehicle door lock as claimed in claim 9, wherein the local-release lever is connected to the local-actuation device such that the local-release lever is driven about a local-release lever rotational axis in a local-release lever actuating direction.

11. The vehicle door lock as claimed in claim 10, wherein the local-release lever is connected to a local-release spring such that the local-release lever is driven about the local-release lever rotational axis counter to the local-release lever actuating direction.

12. The vehicle door lock as claimed in claim 9, wherein the actuating lever is directly connected to the local-release lever such that the actuating lever is driven about an actuating lever rotational axis in an actuating lever actuating direction.

13. The vehicle door lock as claimed in claim 9, wherein the local-release lever has a local-release lever driving arm and a local-release lever driven arm which enclose with one another an angle.

14. The vehicle door lock as claimed in claim 13, wherein the local-release lever is directly operatively connected to the actuating lever via the local-release lever driven arm.

15. The vehicle door lock as claimed in claim 13, wherein the local-release lever is operatively connected to the local-actuation device via the local-release lever driving arm.

16. The vehicle door lock as claimed in claim 9, wherein the local-actuation device has a door handle arranged close to the rotary latch arrangement, and wherein pulling the door handle actuates the local-release lever.

17. The vehicle door lock as claimed in claim 9, wherein the local-release lever has two mutually parallel local-release lever side surfaces and an encircling local-release lever peripheral edge, with the local-release lever peripheral edge having a local-release lever inner edge and a local-release lever outer edge which merge into one another via a rounded local-release driven arm corner edge and a rounded local-release driving arm corner edge.

18. The vehicle door lock as claimed in claim 17, wherein the local-release driven arm corner edge has, at the inside, a rounded local-release lever driven edge.

19. The vehicle door lock as claimed in claim 18, wherein the actuating lever has an actuating lever driving arm, wherein the actuating lever driving arm has, at the end and on the outer side, a driving surface which has a slightly arched or convex profile as viewed in a side view of the actuating lever, and wherein the local-release lever is directly operatively connected to the actuating lever via the rounded local-release driven edge and the driving surface.

20. The vehicle door lock as claimed in claim 1, wherein the remotely actuable release device has a plate-shaped remote-release lever, wherein the remote-actuation button is mounted on the traverse tube, projects beyond a tube casing, and is configured to be pressed into the traverse tube for actuation of the remote release device, wherein the remote release device is operatively connected to the remote-actuation button, and wherein the cable pull mechanism comprises a pull cable or a pull rod arranged mostly within the traverse tube and operatively connected to the remote-actuation device and to the remote-release lever.

21. The vehicle door lock as claimed in claim 20, wherein the remote-release lever is connected to the remote-actuation button via the remote-actuation device and the cable pull mechanism such that the remote-release lever is driven about a remote-release lever rotational axis in a remote-release lever actuating direction.

22. The vehicle door lock as claimed in claim 21, wherein the remote-release lever is directly connected to the actuating lever such that the remote-release lever is driven about the remote-release lever rotational axis counter to the remote-release lever actuating direction.

23. The vehicle door lock as claimed in claim 20, wherein the actuating lever is directly connected to the remote-release lever such that the actuating lever is driven about an actuating lever rotational axis in an actuating lever actuating direction.

24. The vehicle door lock as claimed in claim 20, wherein the remote-release lever is of plate-shaped and elongated design and has two mutually parallel remote-release lever side surfaces and an encircling remote-release lever peripheral edge.

25. The vehicle door lock as claimed in claim 24, wherein a remote-release lever rotational axis of the remote-release lever, is perpendicular to the two mutually parallel remote-release lever side surfaces.

26. The vehicle door lock as claimed in claim 20, wherein the remote-release lever is arranged at a rotary-latch-side end of the traverse tube.

27. The vehicle door lock as claimed in claim 20, wherein the remote-release lever has a remote-release lever driving arm and a remote-release lever driven arm.

28. The vehicle door lock as claimed in claim 27, wherein the remote-release lever is directly operatively connected to the actuating lever via the remote-release lever driven arm.

29. The vehicle door lock as claimed in claim 27, wherein the remote-release lever is operatively connected to the remote-actuation button via the remote-release lever driving arm.

30. The vehicle door lock as claimed in claim 27, wherein the remote-release lever driven arm has a remote-release lever driven edge which has an arched profile and is aligned so as to face toward the actuating lever.

31. The vehicle door lock as claimed in claim 30, wherein the actuating lever has an actuating lever driving arm, wherein the actuating lever driving arm has, at the end and on the outer side, a driving surface which has a slightly arched or convex profile as viewed in a side view of the actuating lever, and wherein the remote-release lever is directly operatively connected to the actuating lever via the remote-release driven edge and the driving surface.

32. The vehicle door lock as claimed in claim 21, wherein the locally actuable release device has a local-release lever, wherein the local-release lever is connected to the local-actuation device such that the local-release lever is driven about a local-release lever rotational axis in a local-release lever actuating direction, and wherein the local-release lever rotational axis is parallel to the remote-release lever rotational axis.

33. The vehicle door lock as claimed in claim 32, wherein the local-release lever actuating direction is reverse to the remote-release lever actuating direction.

34. The vehicle door lock as claimed in claim 21, wherein the actuating lever is directly connected to the locally actuable release device and to the remotely actuable release device such that the actuating lever is driven about an actuating lever rotational axis in an actuating lever actuating direction, wherein the locally actuable release device has a local-release lever, wherein the local-release lever is connected to the local-actuation device such that the local-release lever is driven about a local-release lever rotational axis in a local-release lever actuating direction, and wherein the local-release lever rotational axis and the remote-release lever rotational axis are perpendicular to the actuating lever rotational axis.

35. The vehicle door lock as claimed in claim 27, wherein the locally actuable release device has a local-release lever, wherein the local-release lever has two mutually parallel local-release lever side surfaces, wherein the remote-release lever has two mutually parallel remote-release lever side surfaces, wherein the local-release lever has a local-release lever driving arm and a local-release lever driven arm which enclose with one another an angle, wherein the local-release lever and the remote-release lever are arranged such that the two mutually parallel local-release lever side surfaces are parallel to the two mutually parallel remote-release lever side surfaces, and wherein the remote-release lever driven arm and the local-release lever driven arm are arranged so as to partially overlap, or be partially in alignment with one another or one above the other, in a direction perpendicular to the two mutually parallel remote-release lever side surfaces.

36. The vehicle door lock as claimed in claim 1, wherein the at least one rotary latch is of plate-shaped design.

37. The vehicle door lock as claimed in claim 1, wherein the at least one rotary latch is connected to in each case one rotary latch spring such that the at least one rotary latch is driven in a rotary latch opening direction about a rotary latch rotational axis.

38. The vehicle door lock as claimed in claim 1, wherein the at least one rotary latch has in each case one locking lug with a recess, which serves to receive a closing bolt which extends perpendicular to a base plate of the lock case.

39. The vehicle door lock as claimed in claim 38, wherein a peripheral edge of the at least one rotary latch is substantially opposite the locking lug and has in each case one toothing having in each case at least one rotary latch detent lug and an interposed detent depression, with the toothing being designed such that the toothing interacts with the at least one pivotable pawl so as to lock the at least one rotary latch in the fully closed or pre-latched position thereof.

40. The vehicle door lock as claimed in claim 1, wherein the at least one rotary latch comprises two rotary latches, wherein the at least one pivotable pawl comprises two pawls, and wherein in each case one pawl of the two pawls interacts with a rotary latch of the two rotary latches so as to lock the rotary latch.

41. The vehicle door lock as claimed in claim 40, wherein the two pawls each have a pawl actuating section at one end and a pawl mounting section at the other end.

42. The vehicle door lock as claimed in claim 41, wherein the two pawls are mounted in the region of the respective pawl mounting section so as to be rotatable in each case about a pawl rotational axis.

43. The vehicle door lock as claimed in claim 42, wherein the pawl actuating section has in each case one integrally formed pawl detent lug which is designed in each case so as to point toward the rotary latch to be blocked and which engages into toothing of the rotary latch so as to lock the rotary latch.

44. The vehicle door lock as claimed in claim 43, wherein the two pawls are connected to in each case one pawl spring such that the two pawls are driven about the respective pawl rotational axis counter to a pawl actuating direction and such that the integrally formed pawl detent lugs are pushed in the direction of the two rotary latches counter to a rotary latch peripheral edge.

45. The vehicle door lock as claimed in claim 41, wherein the two pawls have, at the actuating-section-side end, in each case one actuating or contact projection which likewise extends in the direction of the two rotary latches and which serves as a contact and engagement surface for the actuating lever.

46. The vehicle door lock as claimed in claim 40, wherein the two pawls are directly connected to the actuating lever such that the two pawls can be driven about a pawl rotational axis in a pawl actuating direction.

47. The vehicle door lock as claimed in claim 45, wherein actuating surfaces of the actuating lever are directly operatively connected to the actuating or contact projections of the two pawls.

48. The vehicle door lock as claimed in claim 1, wherein the release mechanism has an angle plate which has two plate limbs which are at angles to one another and in each case rectangular, a fastening or connecting plate for rotatably mounting the actuating lever and for fastening the release mechanism to the lock case, and a mounting plate for mounting some individual parts of the locally actuable release device and of the remotely actuable release device.

49. The vehicle door lock as claimed in claim 48, wherein the fastening or connecting plate has a lever passage cutout which extends into the fastening or connecting plate from an end-side fastening plate longitudinal edge.

50. The vehicle door lock as claimed in claim 48, wherein the actuating lever is connected to the fastening or connecting plate so as to be rotatable about an actuating lever rotational axis, with the actuating lever rotational axis being parallel to the fastening or connecting plate and to the mounting plate.

51. The vehicle door lock as claimed in claim 48, wherein the locally actuable release device has a local-release lever, and wherein the local-release lever is connected to the mounting plate so as to be rotatable about a local-release lever rotational axis of the local-release lever, with the local-release lever rotational axis being perpendicular to the mounting plate.

52. The vehicle door lock as claimed in claim 48, wherein the remotely actuable release device has a remote-release lever, and wherein the remote-release lever is connected to the mounting plate so as to be rotatable about a remote-release lever rotational axis of the remote-release lever, with the remote-release lever rotational axis being perpendicular to the mounting plate.

53. The vehicle door lock as claimed in claim 51, wherein the local-release lever can be rotated about the local-release lever rotational axis in a local-release lever actuating direction, and wherein the mounting plate has a stop lobe which is integrally formed centrally on an end-side mounting plate longitudinal edge of said mounting plate and which extends inward in relation to the angle plate and perpendicular to the mounting plate, which stop lobe serves as an abutment for rotational movement of the local-release lever counter to the local-release lever actuating direction.

54. The vehicle door lock as claimed in claim 53, wherein the local-release lever has a local-release lever driving arm and a local-release lever driven arm which enclose with one another an angle, and wherein the local-release lever, in a non-actuated position, bears with a local-release lever outer edge in the region of the local-release lever driven arm against the stop lobe.

55. The vehicle door lock as claimed in claim 48, wherein the remotely actuable release device has a remote-release lever, and wherein the remote-release lever, in a non-actuated position, bears with its remote-release driving corner edge against the fastening or connecting plate at the inner side.

56. The vehicle door lock as claimed in claim 48, wherein the fastening or connecting plate has an abutment for rotational movement of the actuating lever counter to an actuating lever actuating direction.

57. The vehicle door lock as claimed in claim 48, wherein the actuating lever has an actuating lever output arm, an actuating lever driving arm, and actuating surfaces, and wherein in a non-actuated position of the actuating lever, the actuating surfaces are aligned away from the mounting plate and, here, the actuating lever driving arm extends, in relation to the angle plate, at the inside and substantially parallel to the fastening or connecting plate, with the actuating lever output arm being arranged substantially parallel to the mounting plate.

58. The vehicle door lock as claimed in claim 48, wherein the traverse tube is connected to the mounting plate such that the transverse tube can be fixed in a variably pivotable fashion.

59. The vehicle door lock as claimed in claim 4, wherein the actuating lever output arm and the actuating lever driving arm are substantially perpendicular to one another.

* * * * *

UNITED STATES PATENT AND TRADEMARK OFFICE

CERTIFICATE OF CORRECTION

PATENT NO. : 8,827,327 B2
APPLICATION NO. : 12/450716
DATED : September 9, 2014
INVENTOR(S) : Kutschat It is certified that error appears in the above-identified patent and that said Letters Patent is hereby corrected as shown below:

In the Claims

In Column 15, line 15, please change "lever," to correctly read:
--lever--.

Signed and Sealed this
Twenty-fifth Day of November, 2014

Michelle K. Lee

Michelle K. Lee
*Deputy Director of the United States Patent and Trademark Office*